United States Patent [19]

Bell

[11] 4,255,629

[45] Mar. 10, 1981

[54] CRASH AND ROLLOVER CUTOFF SWITCH

[75] Inventor: Lon E. Bell, Altadena, Calif.

[73] Assignee: Technar Incorporated, Arcadia, Calif.

[21] Appl. No.: 28,580

[22] Filed: Apr. 9, 1979

[51] Int. Cl.[3] ..... H01H 35/14

[52] U.S. Cl. ..... 200/61.45 R; 200/61.5; 337/2

[58] Field of Search ..... 200/61.45 R, 61.48, 200/61.49, 61.5, 61.51, 61.52; 337/1, 2, 103, 107

[56] References Cited

U.S. PATENT DOCUMENTS 3,518,385 6/1970 Boudes et al. ..... 200/61.45 R 3,745,277 7/1973 Shawcross et al. ..... 200/61.5

3,842,382 10/1974 Bell ..... 337/107

*Primary Examiner*—James R. Scott

*Attorney, Agent, or Firm*—Christie, Parker & Hale

[57] ABSTRACT

A crash-sensing switch assembly for breaking an electrical circuit has a weight pivotally supported on a horizontal surface with the center of gravity above the surface. The weight is free to move away from the surface if the assembly is inverted. Movement of the weight away from the surface, either by tilting or falling, brings the weight into engagement with the trip lever of a latch, releasing a switch to break the circuit.

12 Claims, 6 Drawing Figures

CRASH AND ROLLOVER CUTOFF SWITCH

FIELD OF THE INVENTION

This invention relates to vehicle crash sensing switches, and more particularly, is concerned with a cutoff switch for turning off a fuel pump or the like either in a crash or rollover situation.

BACKGROUND OF THE INVENTION

With the increased use of electric fuel pumps mounted in or adjacent the gas tanks to pump gasoline from the tank to the engine, there has developed the problem of cutting off the pumping of the fuel following a crash or rollover of the vehicle. Unless the ignition switch is turned off, the fuel pump may continue to pump fuel, adding to the likelihood of fire breaking out, particularly if the fuel line has been broken during the crash. Such a switch must be sensitive to impacts on the vehicle from any horizontal direction. It must not be sensitive to impacts in a vertical direction such as experienced in going over a severe bump, chuckhole, or the like. In addition to being sensitive to impact situations, the switch also should respond to situations where the vehicle may be rolled over without experiencing any substantial horizontally-directed impact, such as where a car swerves out of control, rolls off an embankment, or the like.

SUMMARY OF THE INVENTION

The present invention is directed to a cutoff switch which is actuated either by a horizontal acceleration force from any direction or to inversion of the switch, such as occurs in a rollover situation. Sensitivity to these two distinct conditions is separately controllable. At the same time the switch is rugged in its construction, simple in design and inexpensive to manufacture, thus making it particularly suitable for the mass production automotive market.

In brief, the present invention provides a crash switch comprising a housing having a normally horizontal surface on which is supported an inertial member having two sections, a pivot section resting on the horizontal surface and a movable weight supported on the pivot section, the pivot section constraining movement of the weight along an axis away from the horizontal surface on which the pivot member rests. A spring urges the pivot member against the horizontal surface of the housing. Switch means including a tripping member is mounted in the housing above the weight. Tipping of the pivot section and weight against the urging of the spring or vertical movement of the weight relative to the pivot member when the crash switch is inverted brings the weight into contact with the tripping member to actuate the switch.

BRIEF DESCRIPTION OF THE DRAWINGS

For a more complete understanding of the invention, reference should be made to the accompanying drawings, wherein.

DETAILED DESCRIPTION

Figure 1:
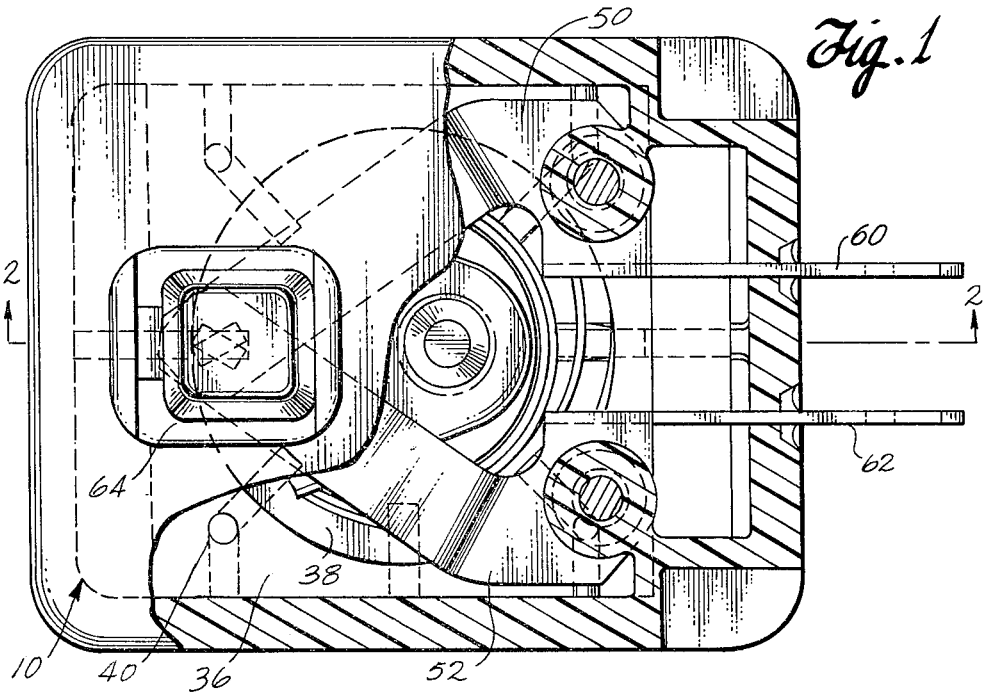
FIG. 1 is a top view, partially cut away of the switch assembly.
Figure 2:
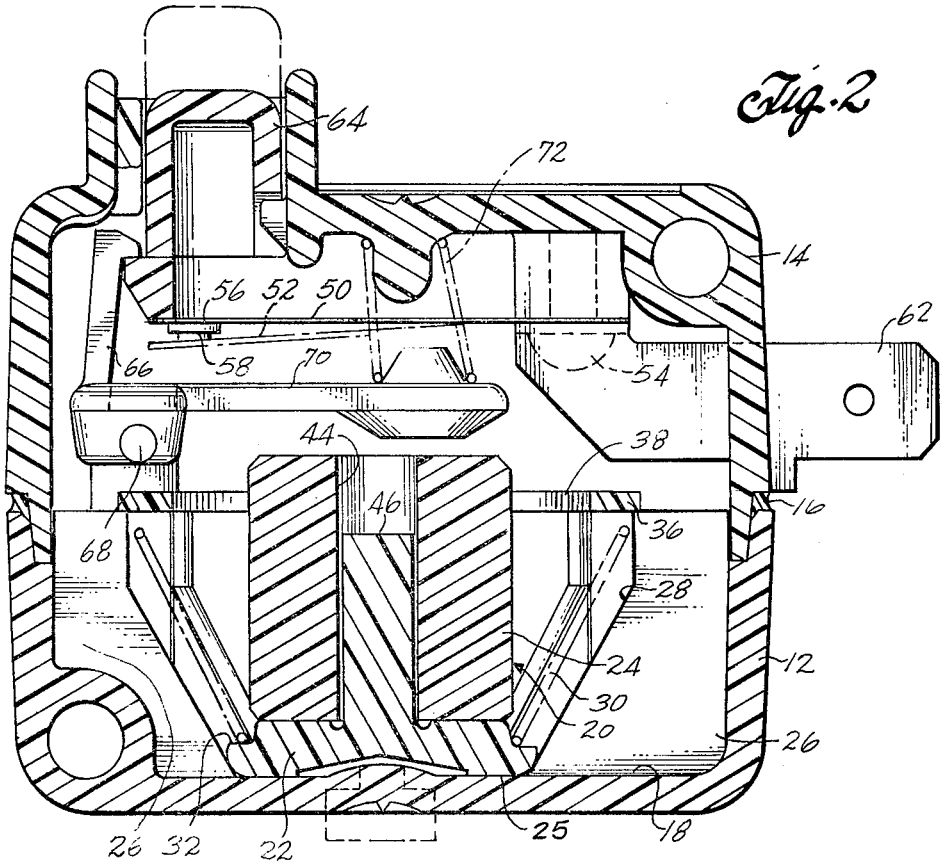
FIG. 2 is a sectional view taken substantially on the line 2—2 of FIG. 1.

Referring to the embodiment of FIGS. 1 and 2 in detail, the numeral 10 indicates generally the housing of the switch which is constructed in two molded parts, a bottom section 12 and a top section 14 having a lip which fits inside the bottom section. The two sections are joined after assembly by a potting compound 16 to secure the two parts of the housing together and to form a seal. The interior of the housing 10 is formed with a lower horizontal surface 18 on which rests an inertial member, indicated generally at 20. The inertial member is in two sections, a pivot section 22 and a cylindrical weight 24. Pivot section 22 has a circular bottom surface 25 on which the inertial member 20 is supported on the horizontal surface 18. The lower part 12 of the housing is provided with a plurality of integrally molded ribs 26, the inner edge 28 of the ribs being tapered inwardly toward the bottom surface 18. The ribs act to center the pivot section 22 against lateral sliding movement.

A coil spring 30 is positioned between the inner edge of the ribs and the inertial member 20. The spring 30 is in the form of an inverted truncated cone, the lower smaller diameter end of the spring engaging a shoulder 32 around the perimeter of the pivot section 22. The spring 30 is held in place in a state of compression by a retaining member 36. The retaining member has a circular opening 38 through which the upper end of the cylindrical weight 24 projects. The outer perimeter of the retaining member is substantially square and rests on top of the ribs 26, preferably being held in place by integrally molded pins 40 at each corner which project from the top of the ribs and extend through holes in the retaining member 36. The pins can be cemented or fused to the retaining member after assembly.

The cylindrical weight 24 has a central opening 44 which slides over a pin 46 projecting vertically upwardly from the top of the pivot section 22. The pin 46 restrains the weight 24 from lateral movement while acting as a guide for upward movement of the weight 24 along a vertical axis. Because the center of gravity of the cylindrical weight 24 is above the horizontal plane 18, an impact imparted to the housing from any horizontal direction will cause inertial member to tilt. This tilting action, of course, is resisted by the bias force of the spring 30 and the downward force produced by the weight 24. Tilting will occur if the impact is of sufficient magnitude to overcome these two forces tending to hold the pivot member 22 against the horizontal surface 18. Also, if the housing is inverted, the weight 24 will move under the action of gravity away from the pivot section 22 without any restraint except the sliding friction between the weight 24 and the pin 46.

Either a tilting motion of the weight 24 or a translational motion along the vertical axis of the weight 24 causes the tripping of a switch assembly mounted in the top portion 14 of the housing 10. The switch assembly includes a pair of contact leaf springs 50 and 52 which are secured to the top section of the housing 10 by drive pins, screws, or the like, as indicated at 54. The outer ends of the leaf springs 50 and 52 overlap, the overlapping ends having electrical contacts 56 and 58 secured respectively to the springs 50 and 52. The other ends of the springs terminate in a pair of connector terminals 60 and 62 which extend outside the housing for making an electrical connection to an external circuit.

The switch is controlled by a push button 64 which projects out the top of the housing. When the push button is depressed into the position shown in FIG. 2, it engages the upper leaf spring 50 pushing it downward into contact with the lower leaf spring 52, bringing the electrical contacts 56 and 58 together and completing an electrical circuit between the connector terminals 60 and 62. The push button 64 is held in the depressed position by a latch 66 which is pivotally supported in the housing by hinge pins 68 at either end that engage holes in the opposite side walls of the housing. A trip member 70 is integrally molded with the latch 66 for pivotal motion about the pins 68. Trip member 70 extends above the weight 24. A coil compression spring 72, extending between the trip member 70 and the top of the housing, urges the trip member toward the weight 24 and the latch 66 into latching engagement with the button 64. Any tilting motion of the weight 24 or vertical movement of the weight 24 brings the weight into engagement with the trip member 70, rotating the trip member 70 and releasing the latch 66. The leaf spring 50 pushes the released button 64 to its extended position where it projects out the top of the housing. At the same time, the spring 50 moves the contact 56 out of engagement with the contact 58, breaking the circuit between the connector terminals 60 and 62. The switch can be reset by depressing the button 64 to re-engage the latch 66 and close the contacts 56 and 58.

Figure 3:
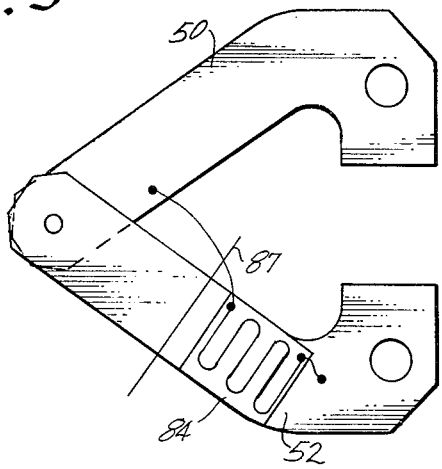
FIG. 3 is a partial top view of a further modification to the switch which provides an automatic reset feature.

An alternative design for the inertial member 20 is shown in FIG. 3 in which the pivot section 22 of the inertial member is cup-shaped to provide a vertical cylindrical wall 80 which acts as a guide for a weight 82 in the form of a spherical ball. As in the arrangement of FIGS. 1 and 2, tilting of the inertial member in any direction relative to the horizontal surface 18 brings the ball 82 into engagement with the trip member 70 to release the latch and open the switch. Inversion of the switch housing causes the ball 82 to roll into contact with the trip member 70 with the same result.

Figure 4:
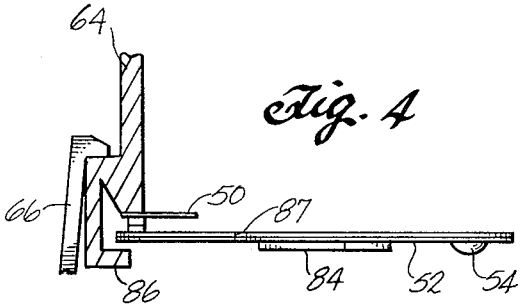
FIG. 4 is a partial side view of the modification of FIG. 3.
Figure 5:
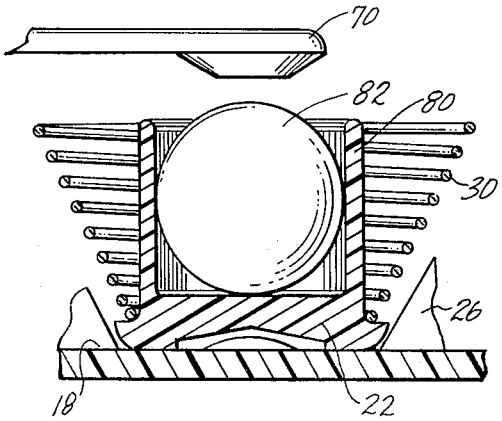
FIG. 5 is a partial view of another embodiment of the invention.

A further modification, shown in FIGS. 4 and 5, provides an automatic resetting feature. The leaf spring 52 is made of bimetal material and is provided with an electrical resistance heating element 84. The heating element is connected electrically to the leaf spring members 50 and 52 so that when the contacts 56 and 58 are opened by a release of the latch 66, a trickle current through the heater element 84 and the external load causes the bimetal element of the leaf spring 52 to be heated up. As the bimetal is heated, the outer end bends downwardly engaging a catch 86 which is integral with the push button 64. While the push button 64 has been shown in the modification of FIG. 4, the projecting portion of the push button 64 is no longer needed since manual resetting is no longer required. This causes the push button to be moved back down to the point where the latch 66 is re-engaged. However the contacts 56 and 58 remain separated because the bimetal element is still bent downwardly. Once the ignition is turned off and power is interrupted to the heater 84, the bimetal of the leaf spring 52 cools off, causing the contact 58 to move back against the contact 56 to short out the heater element and restore normal operation. The bimetal material of the leaf spring 52 is preferably ambient compensated so as not to be affected by normal swings in ambient temperature to which the automobile is subjected. Ambient compensation may be provided by reversing the bimetal materials at an intermediate point, such as along the line 87 in FIG. 4.

While the pivot member in each instance has been described as having a circular shaped pivot surface, the switch can be made directionally sensitive by utilizing a non-circular shape for the perimeter of the pivot surface. Thus the pivot member may be caused to tip more easily in one direction than in another in response to lateral forces.

Figure 6:
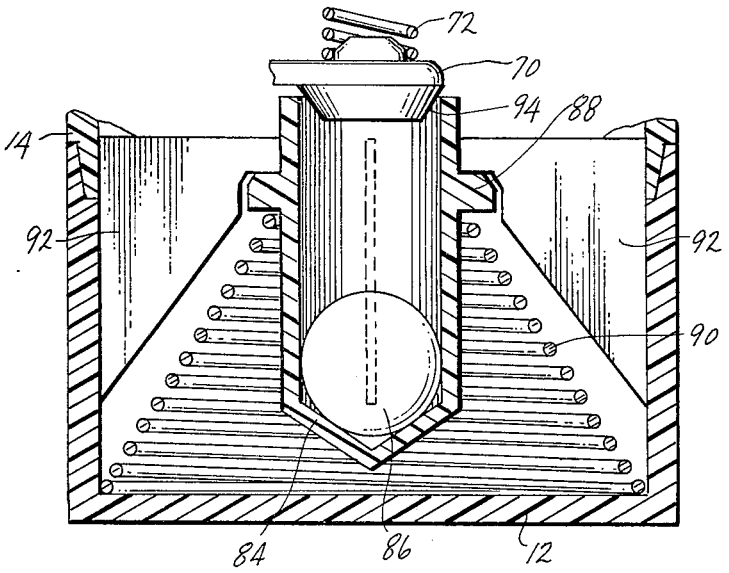
FIG. 6 is a partial side view of a further modification of the invention.

In yet another modification of the invention as shown in FIG. 6, the pivot member is inverted. The pivot member, as indicated at 84 in FIG. 6, is preferably cup-shaped to receive a weight in the form of a ball 86. The pivot member 84 has a flange 88. A frustoconical coil spring 90 supports the pivot member from the bottom wall of the housing. The spring 90 is held in a state of compression by a plurality of radially projecting stop members 92 secured to the walls of the housing and projecting inwardly over the top of the flange 88. The top edge of the pivot member 84 engages or is very closely spaced from the trip member 70.

In operation, the arrangement of FIG. 6 operated similarly to the embodiments described above. Because the center of gravity of the weight 86 is below the pivot plane formed by the top of the flange 88, any lateral forces applied to the housing cause the housing to shift laterally in relation to the weight 86, causing the tilt member 84 to tip. This causes the upper edge of the pivot member 84 to move laterally into engagement with the conical surface 94 of the trip member 70, wedging the trip member 70 upwardly and releasing the latch on the switch. Likewise, inverting the housing causes the weight 86 to drop into engagement with the trip member 70, again releasing the latch on the switch. The arrangement of FIG. 6 has the advantage that small amounts of moisture accumulating inside of the bottom of the housing 12 will not interfere with the action of the switch. In the arrangement of FIGS. 1 and 2 any moisture accumulating between the bottom 18 of the housing 12 and the pivot surface 25 of the pivot member 22 could freeze the pivot member in position thereby disabling the switching mechanism.

What is claimed is:

1. A switching device comprising:

a housing, an inertial member including a movable weight and guide means normally supporting the weight in the housing, the weight being freely movable relative to the guide means along a linear axis when the inertial member is inverted; means pivotally mounting the guide means in the housing with said linear axis normally extending vertically through the center of gravity of said weight, the guide means pivoting about a point offset from the center of gravity of the weight, whereby an accelerating force acting in a direction transverse to said linear axis causes the guide means and the weight to tilt as a unit about the pivot point and a force acting parallel to the linear axis moves the weight relative to the guide means along said axis; spring means urging the guide means into a predetermined angular position relative to the housing, the tilting of the guide means in any direction about the pivot point being resisted by the spring means; and means activating the switch means in response to movement of the weight with tilting of the guide means or movement of the weight along said axis.

2. Apparatus of claim 1 wherein the housing includes a surface lying in a plane, the guide means having a circular area normally held in contact with said surface by said spring means, said linear axis extending perpendicular to the circular area, the guide means tilting about a point on the edge of the circular area relative to said surface.

3. Apparatus of claim 2 wherein the switch means includes a pair of contacts, latch means holding the contacts together, the means activating the switch including an arm pivotally supported in the housing, the arm extending across the path of movement of the weight, whereby the arm is engaged by the weight with movement of the weight from its normal position, the arm, when pivoted, releasing the latch means, and spring means separating the contacts when the latch means is released.

4. Apparatus of claim 3 further including reset means for moving the switch contacts together and engaging the latch means.

5. Apparatus of claim 1 wherein the center of gravity of the weight is vertically higher than the pivot point, and the spring means and the weight both urge the guide means downwardly in the housing.

6. Apparatus of claim 1 wherein the center or gravity is normally vertically lower than the pivot point, and the spring means urges the guide means upwardly in the housing while the weight urges the guide means downwardly in the housing.

7. A crash switch assembly adapted to be mounted on a vehicle or the like, comprising:

support means having a normally horizontal surface, a pivot member having a base resting on said surface, a movable weight freely supported on the pivot member with the center of gravity of the weight above said surface, guide means providing free vertical movement of the weight relative to the pivot member along an axis extending away from said surface, switch means, and trip means operatively associated with the switch means and extending above the weight for activating the switch when the trip means is engaged by the weight moving away from said pivot member along said axis.

8. The apparatus of claim 7 wherein said support means includes stop means limiting lateral movement of the pivot member in any direction parallel to said surface.

9. The apparatus of claim 8 further including spring means engaging the pivot member for urging the pivot member against said surface.

10. The apparatus of claim 9 wherein the switch means includes a pair of electrical contacts, and latch means holding the contacts together, the trip means releasing the latch means and allowing the contacts to separate.

11. The apparatus of claim 10 wherein the switch means includes a bimetal element supporting one of said contacts, heater means associated with the bimetal element, means activating the heater means when the latch means is released, the heater means heating the bimetal element to produce bending of the element in a direction to move the contacts away from each other, and means responsive to the bending of the heated bimetal element for resetting the latch means.

12. Apparatus of claim 11 further including a reset button for moving one of said contacts relative to the other contact, and means activated by the reset button for moving the contacts together and resetting the latch means.

* * * * *